US011400424B2

(12) United States Patent
Xu

(10) Patent No.: US 11,400,424 B2
(45) Date of Patent: Aug. 2, 2022

(54) MICRO-BUBBLE ACQUISITION APPARATUS

(71) Applicant: JODEN INC., Jiangmen (CN)

(72) Inventor: Zhengfeng Xu, Jiangmen (CN)

(73) Assignee: JODEN INC., Jiangmen (CN)

( * ) Notice: Subject to any disclaimer, the term of this patent is extended or adjusted under 35 U.S.C. 154(b) by 0 days.

(21) Appl. No.: 17/260,429

(22) PCT Filed: Mar. 15, 2019

(86) PCT No.: PCT/CN2019/078206
§ 371 (c)(1),
(2) Date: Jan. 14, 2021

(87) PCT Pub. No.: WO2020/034635
PCT Pub. Date: Feb. 20, 2020

(65) Prior Publication Data

US 2021/0260539 A1 Aug. 26, 2021

(30) Foreign Application Priority Data

Aug. 15, 2018 (CN) ..... 201810926313.8

(51) Int. Cl.

| | |
|---|---|
| ***B01F 23/23*** | (2022.01) |
| ***B01F 25/10*** | (2022.01) |
| ***B01F 23/232*** | (2022.01) |
| ***B01F 25/452*** | (2022.01) |
| ***B01F 33/81*** | (2022.01) |
| ***B01F 33/82*** | (2022.01) |
| ***B01F 23/231*** | (2022.01) |
| *B01F 23/2373* | (2022.01) |

(Continued)

(52) U.S. Cl.
CPC ..... *B01F 25/103* (2022.01); *B01F 23/231* (2022.01); *B01F 23/232* (2022.01); *B01F 23/2368* (2022.01); *B01F 25/4522* (2022.01); *B01F 33/813* (2022.01); *B01F 33/821* (2022.01); *B01F 23/2373* (2022.01); *B01F 23/237611* (2022.01); *B01F 2025/914* (2022.01); *B01F 2101/305* (2022.01)

(58) Field of Classification Search
CPC ..... B01F 23/231
See application file for complete search history.

(56) References Cited

U.S. PATENT DOCUMENTS 8,939,436 B2 * 1/2015 Takase ..... B01F 5/0062 261/76

FOREIGN PATENT DOCUMENTS

CN 102958589 A 3/2013
CN 203916477 U 11/2014

(Continued)

*Primary Examiner* — Robert A Hopkins
(74) *Attorney, Agent, or Firm* — Epstein Drangel LLP; Robert L. Epstein

(57) ABSTRACT

A micro-bubble acquisition apparatus is disclosed including a first body in which a water inlet channel, a water outlet channel, a vortex cavity communicating the water inlet channel with the water outlet channel, and an air inlet channel communicated with the vortex cavity are provided. The vortex cavity has an axis offset from an axis of the water inlet channel, the vortex cavity is provided with a water inlet communicated with the water inlet channel, and the water inlet is arranged at a side of the axis of the water inlet channel away from the axis of the vortex cavity.

8 Claims, 5 Drawing Sheets

(51) Int. Cl.

| | |
|---|---|
| *B01F 23/237* | (2022.01) |
| *B01F 25/00* | (2022.01) |
| *B01F 101/00* | (2022.01) |

(56) References Cited

FOREIGN PATENT DOCUMENTS

| | | | |
|---|---|---|---|
| CN | 102958589 | B | 12/2014 |
| CN | 107583479 | A | 1/2018 |
| CN | 107715720 | A | 2/2018 |
| CN | 108905662 | A | 11/2018 |
| CN | 108939970 | A | 12/2018 |
| CN | 208911853 | U | 5/2019 |
| JP | 2015167946 | A | 9/2015 |
| JP | 3202305 | U | 1/2016 |
| TW | M552842 | U | 12/2017 |
| WO | 2016067278 | A1 | 5/2016 |

* cited by examiner

MICRO-BUBBLE ACQUISITION APPARATUS

CROSS-REFERENCE TO RELATED APPLICATIONS

This application is a national stage filing under 35 U.S.C. § 371 of international application number PCT/CN2019/078206, filed Mar. 15, 2019, which claims priority to Chinese patent application No. 2018109263138 filed Aug. 15, 2018. The contents of these applications are incorporated herein by reference in their entirety.

FIELD

The present disclosure relates to a fluid apparatus, and in particular relates to a micro-bubble acquisition apparatus.

BACKGROUND

In the related technology, in the fields of aquaculture, wastewater treatment, chemical reaction, medical and health care, plant cultivation, industrial cleaning and descaling, and the like, it is often necessary to mix air into a water medium to obtain a bubble-contained water working medium, which is intended to increase a contact area between the air and the water to improve various treatment effects. Most obviously, cleaning and descaling abilities are improved.

In recent years, the bubble-contained water working medium is also applied to the field of daily life, which may be used for soaking or washing vegetables, fruits and dishes, and may also be used for bathing and rinsing.

In order to make the water contain bubbles, the air may be pressed in by external power, such as a compressor and an air pump. The air may also be sucked in by using a negative pressure generated by flow of the water, such as a bubble acquisition apparatus with a Venturi tube structure or a vortex structure.

The bubble acquisition apparatus with the Venturi tube structure mainly utilizes a principle that water pressure will decrease as water flow speed increases. The bubble acquisition apparatus with the Venturi tube structure is provided with a tapered pipeline to increase the water flow speed and form a vacuum zone with a pressure lower than the external atmosphere at a throat of the pipeline, and external air is sucked into the pipeline by means of the vacuum zone.

The bubble acquisition apparatus with the vortex structure mainly utilizes a principle of centrifugal movement which causes a low pressure at the center. The bubble acquisition apparatus with the vortex structure makes a water flow rotate and generate a centrifugal action, and then a vacuum zone with a pressure lower than the external atmosphere is formed at a rotating center. The vacuum zone sucks the external air into the pipeline.

The Venturi tube structure specifically refers to China Taiwan patent TW20170212400U entitled micro-bubble generator, and the vortex structure specifically refers to Chinese patents CN102958589B entitled micro-bubble generating apparatus and CN203916477U entitled micro-bubble generating apparatus. The micro-bubble generator and the micro-bubble generating apparatus may collectively refer to a micro-bubble acquisition apparatus.

The micro-bubble acquisition apparatus may make water contain micro-bubbles with a diameter lower than tens of microns or even a plurality of microns, thus prolonging retention time of the bubbles in the water, and increasing a ratio of a surface area to a volume of the bubbles at the same time, so that the bubbles have a higher adsorption characteristic. Therefore, the cleaning and descaling abilities are improved.

Compared with the Venturi tube structure, the vortex structure is advantageous in that the length of the bubble acquisition apparatus can be reduced, and it is insensitive to changes in water flow rate. Therefore, the vortex structure is usually used in the existing micro-bubble acquisition apparatus.

However, in the existing design, center of the vortex structure coincides with center of the pipeline, which means that the vortex cavity is forward, resulting in a narrow annular water inlet of the micro-bubble acquisition apparatus communicated with the vortex structure, so that flow of the water is hindered and air is difficult to be sucked in. However, if the size of the annular water inlet is increased, then the diameter of the micro-bubble acquisition apparatus will increase, which is difficult to adapt to a conventional water pipe specification.

SUMMARY

The present disclosure aims to solve the above-mentioned technical problems, and provides a micro-bubble acquisition apparatus, which can reduce obstruction to flow of water, and avoids increasing a volume of the micro-bubble acquisition apparatus at the same time.

The present disclosure is realized by the following technical themes.

A micro-bubble acquisition apparatus includes a first body in which a water inlet channel, a water outlet channel with a progressive perforation-type crushing and refining structure for crushing bubbles, a vortex cavity communicating the water inlet channel with the water outlet channel, and an air inlet channel communicated with the vortex cavity are provided. The vortex cavity has an axis offset from an axis of the water inlet channel, the vortex cavity is provided with a water inlet communicated with the water inlet channel, and the water inlet is arranged at a side of the axis of the water inlet channel away from the axis of the vortex cavity.

In some embodiments, the first body is provided with a first side wall and a first bottom wall for forming the vortex cavity, and the first side wall is provided with a water inlet hole communicated with the vortex cavity.

In some embodiments, the first body is provided with a beaming part covering the vortex cavity, the beaming part is provided with a water outlet hole communicating the vortex cavity with the water outlet channel, and the water outlet hole has a cross section tapered in a direction of a water flow.

In some embodiments, the beaming part has an outer contour matched with the water outlet channel.

In some embodiments, the beaming part is integrally manufactured with the first side wall.

In some embodiments, the water inlet hole is oriented in a tangential direction of the vortex cavity.

In some embodiments, two water inlet holes are provided.

In some embodiments, the air inlet channel includes a first air channel arranged in an axial direction of the vortex cavity and a second air channel arranged in a radial direction of the vortex cavity, the first air channel is communicated with the second air channel, the first air channel is communicated with the outside, and the second air channel is communicated with the vortex cavity.

In some embodiments, a plurality of vortex cavities are provided, and a number of the water inlets is set corresponding to a number of the vortex cavities.

In some embodiments, the water outlet channel is provided with the progressive perforation-type crushing and refining structure for crushing the bubbles.

Beneficial effects: compared with the related technology, in the micro-bubble acquisition apparatus of the present disclosure, the water inlet is arranged at a side of the axis of the water inlet channel facing away from the axis of the vortex cavity by making the axis of the vortex cavity offset from the axis of the water inlet channel, so that the water inlet channel communicated with the vortex cavity is changed from a narrow ring shape to a crescent shape or a column shape, so as to avoid the water flow from passing through a narrow gap, thus increasing a radial size of the water flow, reducing a water flow resistance, and facilitating the water flow to flow into the vortex cavity. Accordingly, the diameter of the micro-bubble acquisition apparatus is not increased, or is even reduced. Therefore, the micro-bubble acquisition apparatus can be miniaturized, and is conveniently connected with the water pipe or arranged inside the water pipe, thus having a good universality.

BRIEF DESCRIPTION OF THE DRAWINGS

In order to explain the technical themes in the embodiments of the present disclosure more clearly, the accompanying drawings needing to be used in description of the embodiments are briefly described hereinafter.

Obviously, the described accompanying drawings are only some but not all of the embodiments of the present disclosure, and those skilled in the art may also obtain other design schemes and accompanying drawings according to these accompanying drawings without any creative work.

Figure 1:
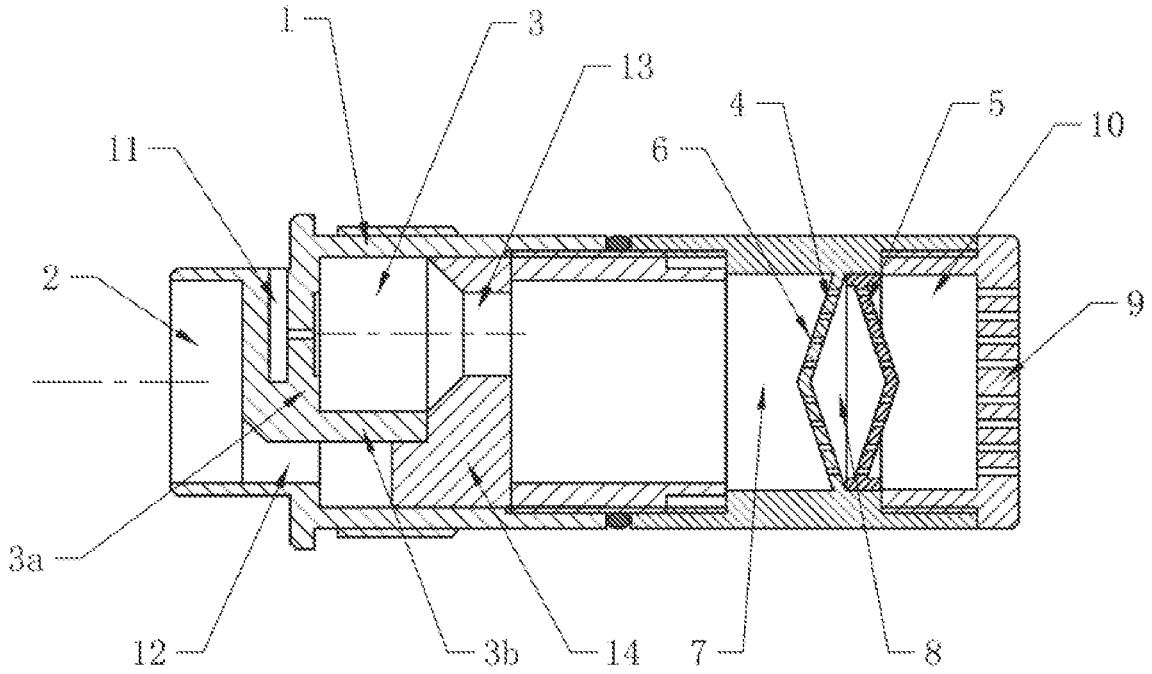
FIG. 1 is a schematic sectional view of a micro-bubble acquisition apparatus of the present disclosure.

Reference numerals of technical features: 1 refers to first body, 2 refers to water inlet channel, 3 refers to vortex cavity, 4 refers to primary crushing and refining part, 5 refers to secondary crushing and refining part, 6 refers to micropore channel, 7 refers to front space, 8 refers to buffer space, 9 refers to last crushing and refining part, 10 refers to transition space, 11 refers to air inlet channel, 12 refers to water inlet, 12*a* refers to water inlet hole, 12*b* refers to auxiliary air inlet pore, 13 refers to water outlet hole, 14 refers to beaming part, 3*a* refers to first bottom wall, 3*b* refers to first side wall, 41 refers to first ring, and 51 refers to positioning edge.

DETAILED DESCRIPTION OF THE EMBODIMENTS

The concept, the specific structure and the generated technical effect of the present disclosure are clearly and completely described hereinafter with reference to the embodiments and the accompanying drawings to fully understand the objectives, the features and the effects of the present disclosure.

Obviously, the described embodiments are only some but not all of the embodiments of the present disclosure, and based on the embodiments of the present disclosure, other embodiments obtained by those skilled in the art without any creative work all belong to the scope of protection of the present disclosure.

In addition, all connection relationships mentioned herein do not indicate direct connection between members only, but indicate that a better connection structure may be formed by adding or reducing a connection accessory according to specific implementation conditions. The various technical features in the present disclosure may be combined interactively on the premise of not conflicting with each other.

Figure 4:
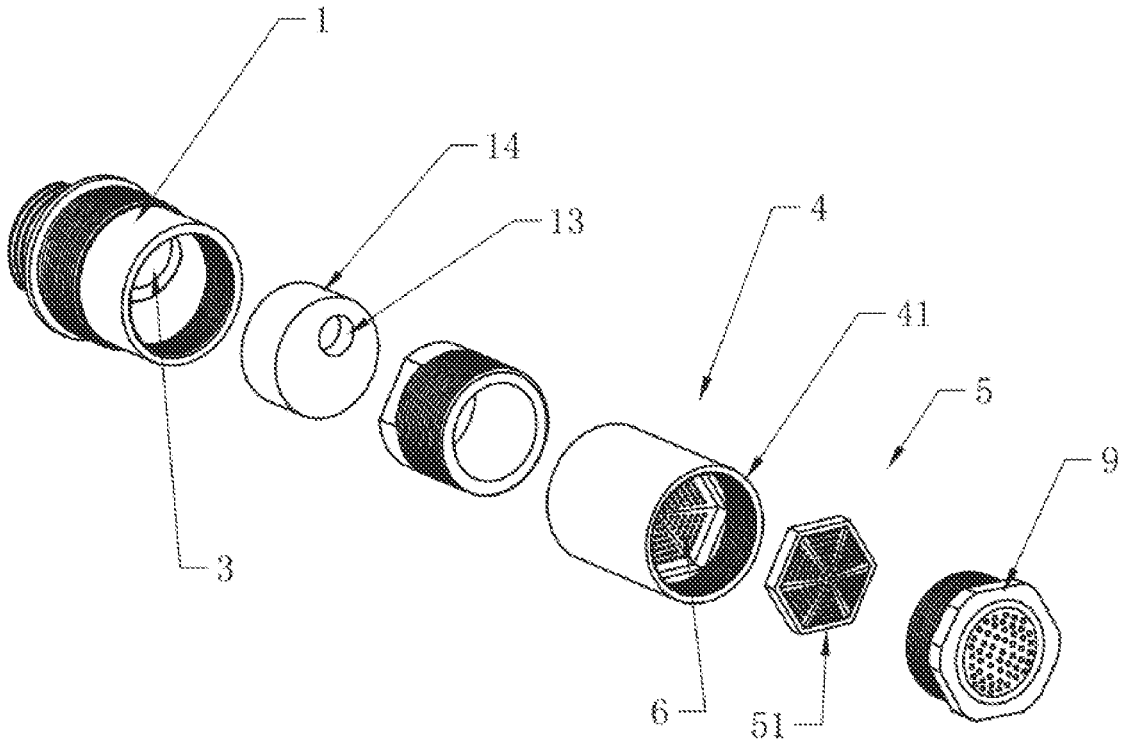
FIG. 4 is a schematic exploded view of the micro-bubble acquisition apparatus in FIG. 1.

As shown in FIG. 1 and FIG. 4, a micro-bubble acquisition apparatus is provided including a first body 1. The first body 1 is provided with a water inlet channel 2, a water outlet channel, a vortex cavity 3 communicating the water inlet channel 2 with the water outlet channel, and an air inlet channel 11 communicated with the vortex cavity 3. The water outlet channel is provided with a structure for generating micro-bubbles. Center lines in FIG. 1 are respectively an axis of the water inlet channel 2 and an axis of the vortex cavity 3.

The air inlet channel 11 may be connected with a compressor, an air pump, and the like, so that air can be pressed into the vortex cavity 3 by using external power. Certainly, the air may also be sucked into the air inlet channel 11 by utilizing a negative pressure generated by flow of water.

Regarding the vortex cavity 3, the first body 1 is provided with a first side wall 3*b* and a first bottom wall 3*a* for forming the vortex cavity 3. The first side wall 3*b* is provided with a water inlet hole 12*a* communicated with the vortex cavity 3, and the water inlet hole 12*a* is oriented to be deviated from a center of the vortex cavity 3, so that a vortex can be generated by water after flowing through the water inlet hole 12*a*.

The water inlet channel 2 is typically arranged on a first bottom wall 3*a*, and the air inlet channel 11 includes a first air channel arranged in an axial direction of the vortex cavity 3 and a second air channel arranged perpendicular to the axial direction of the vortex cavity 3. The first air channel is communicated with the second air channel, the first air channel is communicated with the outside, and the second air channel is communicated with the vortex cavity 3, thus being convenient for manufacturing, without affecting installation and use of the micro-bubble acquisition apparatus.

Regarding the first body 1, one end of the first body 1 close to the water inlet channel 2 may be provided with or integrally formed with a connector, so that the micro-bubble acquisition apparatus can be fixed on a faucet.

Certainly, the first body 1 may also be installed in a water pipe, and the first body 1 and the water pipe are sealed through a sealing ring, so that the water flows into the water inlet channel 2, and then flows out through the vortex cavity 3 and the water outlet channel. In this way, the water inlet channel 2 may be a water channel portion of the water pipe close to the first body 1, and the water inlet channel 2 may be omitted from the first body 1.

In related technology, the axis of the vortex cavity 3 coincides with the axis of the water inlet channel 2, which is referred to as a forward vortex cavity 3 or a forward vortex structure hereinafter, resulting in a narrow annular water inlet 12 of the micro-bubble acquisition apparatus, so that flow of the water is hindered and air is difficult to be sucked in. However, if the size of the annular water inlet is increased, then the diameter of the micro-bubble acquisition apparatus will increase, which is difficult to adapt to a conventional water pipe specification.

Certainly, discussions on advantages and disadvantages of forward and offset vortex structures herein do not affect combination of the forward or offset vortex structure with the following progressive perforation-type crushing and refining structure, that is to say, the forward or offset vortex structure may be combined with the following progressive perforation-type crushing and refining structure to form the micro-bubble acquisition apparatus.

Figure 2:
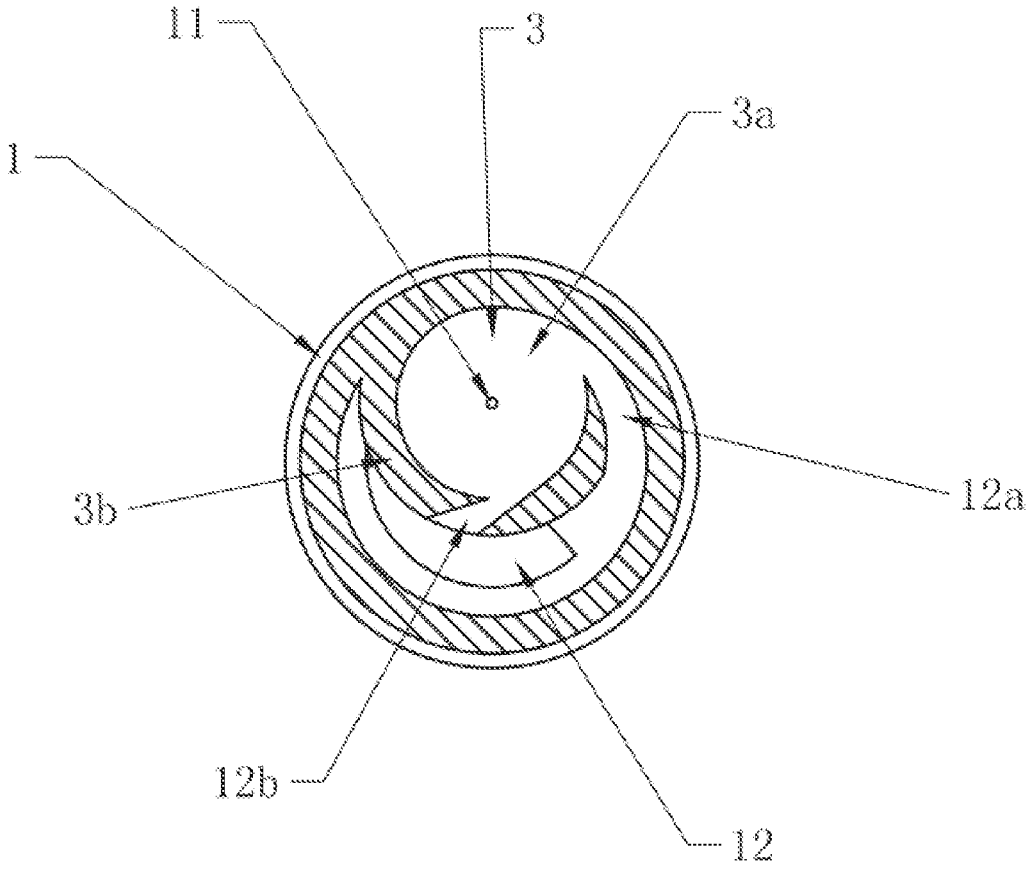
FIG. 2 is a schematic cross-sectional view of a vortex cavity of the micro-bubble acquisition apparatus in FIG. 1.

In order to solve problems caused by the forward vortex cavity 3, as shown in FIG. 1 and FIG. 2, the axis of the vortex cavity 3 may be offset from the axis of the water inlet channel 2, the vortex cavity 3 is provided with a water inlet 12 communicated with the water inlet channel 2, and the water inlet 12 is arranged at a side of the axis of the water inlet channel 2 away from the axis of vortex cavity 3, which means that, an offset vortex structure is used.

In the micro-bubble acquisition apparatus in the embodiment, the water inlet 12 is arranged at a side of the axis of the water inlet channel 2 away from the axis of the vortex cavity 3 by making the axis of the vortex cavity 3 offset from the axis of the water inlet channel 2, so that the water inlet channel 12 communicated with the vortex cavity 3 is changed from a narrow ring shape to a crescent shape or a column shape, so as to avoid the water flow from passing through a narrow gap, thus increasing a radial size of the water flow, reducing a water flow resistance, and facilitating the water flow to flow into the vortex cavity 3. Accordingly, the diameter of the micro-bubble acquisition apparatus is not increased, or is even reduced. Therefore, the micro-bubble acquisition apparatus can be miniaturized, and is conveniently connected with the water pipe or arranged inside the water pipe, thus having a good universality.

In order to further explain the beneficial effects generated from the embodiment, detailed discussions are now provided.

At present, mainstream pipe diameters of a domestic water pipeline mainly include an outer diameter of 28 mm and an outer diameter of 22 mm, and taking the pipeline with the outer diameter 28 mm as an example, if a bubble generating apparatus is made as a built-in type, an outer diameter thereof must not exceed 24.5 mm. That is to say, the water inlet 12 can only be arranged in an annular area with a width not exceeding 2.5 mm, which makes an area of the water inlet 12 relatively small. Alternatively, compared with a conventional round-hole water inlet 12, an outer contour length of the water inlet 12 is increased, so that flow of the water is hindered. Therefore, a back pressure is greatly increased, which affects the suction effect of a vortex, and even a pipeline flow rate is significantly lowered.

Therefore, the existing forward vortex cavity 3 is difficult to be built into the pipeline with the diameter of 28 mm.

In sharp contrast to the existing design, the offset vortex cavity 3 is used in the present disclosure. Due to offset of the vortex cavity 3, the axis of the vortex cavity 3 is offset from the axis of the water inlet channel 2 by a distance, and the distance allows the water inlet 12 to be arranged in a crescent-shaped area, with a radius difference of 3 mm to 4 mm. The water inlet 12 may be close to an ellipse or a circle from a narrow strip, so that the outer contour length of the water inlet 12 is reduced, thus facilitating the water flow to pass through the water inlet 12, without increasing an outer diameter of the first body 1. In other words, the offset vortex cavity 3 can reduce a volume and an occupied space of the micro-bubble acquisition apparatus, thus being convenient to be built into the domestic water pipe.

Figure 3:
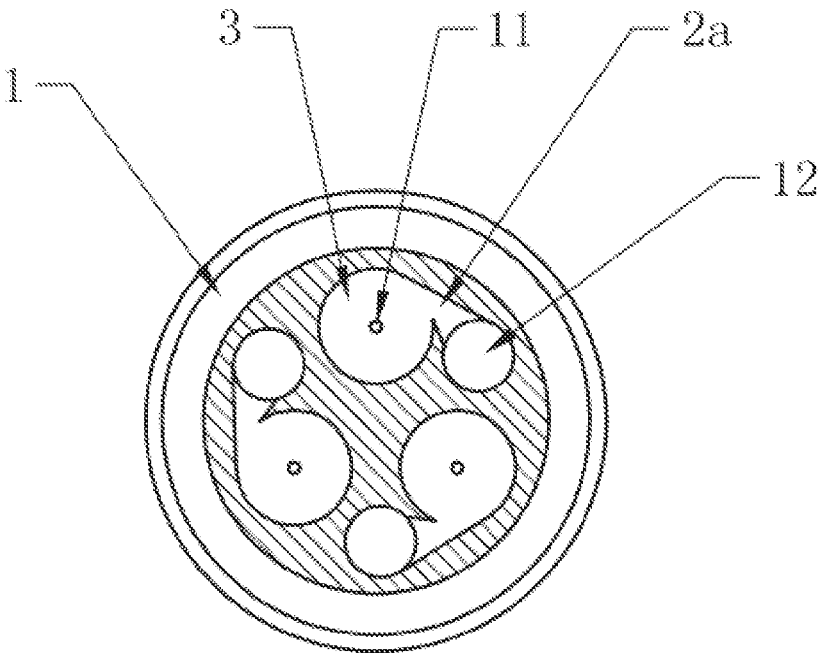
FIG. 3 is a schematic structural view of the micro-bubble acquisition apparatus in FIG. 1 according to another embodiment.

As shown in FIG. 3, as an alternative to the micro-bubble acquisition apparatus in FIG. 1, a plurality of vortex cavities 3 may be provided, and the number of the water inlets 12 is set corresponding to the number of vortex cavities 3. That is to say, a plurality of round-hole water inlets 12 are formed by changing a large vortex cavity 3 into a plurality of small vortex cavities 3, which also can change the narrow condition of the water inlet 12.

As further development of the micro-bubble acquisition apparatus, the first body 1 is provided with a beaming part 14 covering the vortex cavity 3, and the beaming part 14 is provided with a water outlet hole 13 communicating the vortex cavity 3 with the water outlet channel. The water outlet hole 13 has a cross section tapered in the direction of the water flow, so that the air and the water can be fully mixed to generate the bubbles. In addition, change of the cross-sectional area of the water outlet hole 13 can also accelerate the water flow, compress the bubbles, and promote bubble crushing.

In order to simplify manufacturing, an outer contour of the beaming part 14 may be matched with the water outlet channel, which means that the beaming part 14 is manufactured separately, without increasing the difficulty in manufacturing the vortex cavity.

Certainly, the beaming part 14 may also be integrally manufactured with a first side wall 3*b*, but improvement needs to be made on the manufacturing. The first bottom wall 3*a* and the first side wall 3*b* need to be manufactured separately.

In order to make the water generate the vortex flow smoothly, the water inlet hole 12*a* may be oriented in a tangential direction of the vortex cavity 3.

In order to avoid limiting the diameter of the water inlet hole 12*a* which will reduce the water flow rate, two water inlet holes 12*a* may be provided, which means that, an auxiliary water inlet hole 12*b* may be provided, so that a total area of the water inlet hole 12*a* is not decreased or increased.

Figure 5:
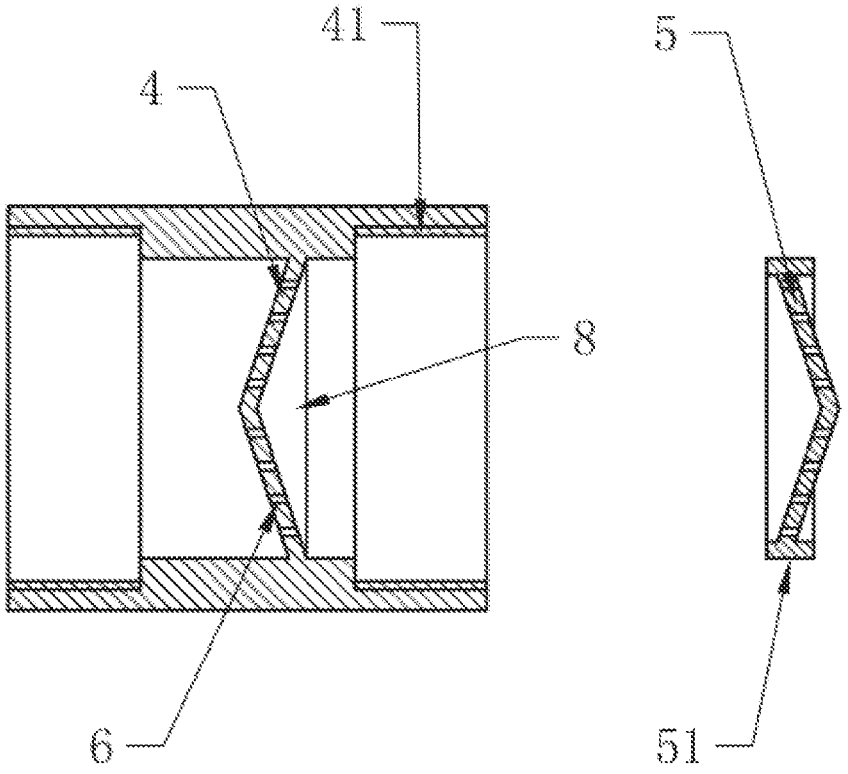
FIG. 5 is a schematic view of a progressive perforation-type crushing and refining structure in the micro-bubble acquisition apparatus of FIG. 1.

In order to solve problems of easy blockage of a filter screen and insufficient level of micro-bubbles generated by a conical mesh in the related technology, as shown in FIG. 1, FIG. 4, and FIG. 5, a progressive perforation-type crushing and refining structure is further used in the micro-bubble acquisition apparatus. Certainly, the progressive perforation-type crushing and refining structure is not only suitable for the micro-bubble acquisition apparatus with the forward vortex structure, but also suitable for the micro-bubble acquisition apparatus with the offset vortex structure.

The progressive perforation-type crushing and refining structure includes a thin-walled primary crushing and refining part 4 and a secondary crushing and refining part 5. The primary crushing and refining part 4 and the secondary crushing and refining part 5 are both provided with a plurality of micro-pore channels 6 for crushing and refining bubbles in a fluid. The primary crushing and refining part 4 and the secondary crushing and refining part 5 cooperate to form a buffer space 8, and the primary crushing and refining part 4 and the secondary crushing and refining part 5 are overlapped or superposed with at least one quarter of the micro-pore channels 6 in a flow direction of the fluid. According to the above micro-bubble acquisition apparatus, the flow direction of the fluid is an axial direction of a channel where the fluid is located.

By providing the progressive perforation-type crushing and refining structure in the embodiment with thin-walled primary crushing and refining part 4 to replace a high-mesh-number filter screen, on one hand, the number of holes is reduced, particles can be deposited, and blockage is delayed, thus prolonging maintenance-free time of a micro-bubble acquisition apparatus; on the other hand, under throttling and beaming actions of the micro-pore channels 6, the water flow becomes a jet turbulent flow after passing through the micro-pore channels 6, with collision, disturbance and oscillation excitation, which can crush large bubbles to obtain finer bubbles, and then, the bubbles are further refined to a micro-nano level by arranging the secondary crushing and refining part 5 to meet a demand. Moreover, by forming the buffer space 8 between the primary crushing and refining part 4 and the secondary crushing and refining part 5, the bubbles can repeatedly collide, disturb and vibrate after passing through the primary crushing and refining part 4. In addition, the primary crushing and refining part 4 and the secondary crushing and refining part 5 are overlapped or superposed with at least one quarter of the micro-pore channels 6 in the flow direction of the fluid, so that the bubbles can smoothly flow to the micro-pore channels 6 of the secondary crushing and refining part 5 from the micro-pore channels 6 of the primary crushing and refining part 4, thus reducing a flow resistance of the water flow, avoiding a relatively large back pressure resistance at the progressive perforation-type crushing and refining structure, without affecting air input of the micro-bubble acquisition apparatus.

The progressive perforation-type crushing and refining structure is provided with the primary crushing and refining part 4 and the secondary crushing and refining part 5, in which the micro-pore channels 6 are opened as outflow channels of a fluid working medium, thus forming a crushing and refining structure with characteristic of two-stage progressive perforation.

The micro-pore channels 6 of the primary crushing and refining part 4 are first-stage perforations, and second-stage perforations are formed by the micro-pore channels 6 of the secondary crushing and refining part 5. When the fluid working medium mixed with the bubbles passes through the first-stage perforations, flow thereof has characteristic of jet flow due to a throttling effect and a beaming action of the micro-pore channels 6. At the moment, flow of the fluid is accelerated, with characteristic of turbulent flow.

Under excitations of collision, disturbance and oscillation of the turbulent flow, large bubbles are crushed, so as to obtain finer bubble water, and then finer bubbles are further crushed and refined by the second-stage perforations, so as to become micro-bubbles finally.

Certainly, in order to make the micro-bubble acquisition apparatus suitable for installation at a tail end of a faucet, a last crushing and refining part 9 may further be provided, which may make the water flow out stably in addition to further refining the bubbles, without affecting a water outlet effect.

In order to improve a bubble crushing ability of the micro-pore channels 6, a diameter of the micro-pore channels 6 or/and an equivalent diameter of the micro-pore channels may be 0.2 mm to 0.8 mm, otherwise the generated bubbles are too large or the water flow rate is insufficient. The equivalent diameter may be calculated through $S=\pi d^2/4$, wherein S is a cross-sectional area of the micro-pore channels 6. That is to say, the micro-pore channels 6 may have a non-circular structure, such as a triangle, an ellipse, a polygon, and other various abnormities.

In order to enhance strength of the primary crushing and refining part 4, and enable the water to flow along a surface of the primary crushing and refining part 4 at the same time, thus crushing the bubbles through the micro-pore channels 6 in a cutting manner, the primary crushing and refining part 4 may be arranged as a cone, and a tip of the cone is arranged in a direction away from the secondary crushing and refining part 5.

In order to form the buffer space 8 without increasing the number of parts and the length of the micro-bubble acquisition apparatus, the secondary crushing and refining part 5 may be arranged as a cone, and a tip of the cone is arranged in a direction away from the primary crushing and refining part 4.

In order to make the water flow parallel to a surface of the primary crushing and refining part 4 or the secondary crushing and refining part 5, the primary crushing and refining part 4 or the secondary crushing and refining part 5 may be arranged as a pyramid. Meanwhile, arrangement of the primary crushing and refining part 4 or the secondary crushing and refining part 5 as a pyramid also facilitates the micro-pore channels 6 of the primary crushing and refining part and the secondary crushing and refining part to be superposed or overlapped.

In order to ensure that relative positions of the micro-pore channels 6 on the primary crushing and refining part 4 and the secondary crushing and refining part 5 meet requirements, a first ring 41 for accommodating the primary crushing and refining part 4 may be formed at an outer edge of the primary crushing and refining part 4.

In order to avoid deflection of the secondary crushing and refining part 5 in the first ring 41, i.e., to accurately install the secondary crushing and refining part 5 in the first ring 41, an outer edge of the secondary crushing and refining part 5 may be provided with a positioning edge 51.

Regarding the last crushing and refining part 9, and a transition space 10 may be formed between the last crushing and refining part 9 and the secondary crushing and refining part 5, so as to make the water flow stable.

In order to further reduce costs and the number of the parts, the primary crushing and refining part 4 and the last crushing and refining part 9 are connected, and clamp and fix the secondary crushing and refining part 5.

The above embodiments are not limited to the technical themes of the embodiments themselves, but may be combined with each other to form new embodiments. The above embodiments are only used to illustrate the technical themes of the present disclosure, but are not intended to limit the present disclosure. Any modification or equivalent substitution made without deviating from the concept and scope of the present disclosure shall all fall within the scope of the technical themes of the present disclosure.

The invention claimed is:

1. A micro-bubble acquisition apparatus, comprising a first body in which a water inlet channel, a water outlet channel with a progressive perforation-type crushing and refining structure for crushing bubbles, a vortex cavity communicating the water inlet channel with the water outlet channel, and an air inlet channel communicated with the vortex cavity are provided, wherein the vortex cavity has an axis offset from an axis of the water inlet channel, the vortex cavity is provided with a water inlet communicated with the water inlet channel, and the water inlet is arranged at a side of the axis of the water inlet channel away from the axis of the vortex cavity, wherein the first body is provided with a first side wall and a first bottom wall for forming the vortex cavity, and the first side wall is provided with a water inlet hole communicated with the vortex cavity.

2. The micro-bubble acquisition apparatus of claim 1, wherein the first body is provided with a beaming part covering the vortex cavity, the beaming part is provided with a water outlet hole communicating the vortex cavity with the water outlet channel, and the water outlet hole has a cross section tapered in a direction of a water flow.

3. The micro-bubble acquisition apparatus of claim 2, wherein the beaming part has an outer contour matched with the water outlet channel.

4. The micro-bubble acquisition apparatus of claim 2, wherein the beaming part is integrally manufactured with the first side wall.

5. The micro-bubble acquisition apparatus of claim 1, wherein the water inlet hole is oriented in a tangential direction of the vortex cavity.

6. The micro-bubble acquisition apparatus of claim 1, wherein two water inlet holes are provided.

7. The micro-bubble acquisition apparatus of claim 1, wherein the air inlet channel comprises a first air channel arranged in an axial direction of the vortex cavity and a second air channel arranged in a radial direction of the vortex cavity, the first air channel is communicated with the second air channel, the first air channel is communicated with outside, and the second air channel is communicated with the vortex cavity.

8. The micro-bubble acquisition apparatus of claim 1, wherein a plurality of vortex cavities are provided, and the number of the water inlets is set corresponding to the number of the vortex cavities.

* * * * *